United States Patent [19]

Nakamura et al.

[11] Patent Number: 4,591,000

[45] Date of Patent: May 27, 1986

[54] AUTOMATIC FIRE-EXTINGUISHING DEVICE FOR OIL BURNER

[75] Inventors: Kazuharu Nakamura, Nagoya; Yutaka Nakanishi, Kounan, both of Japan

[73] Assignee: Toyotomi Kogyo Co., Ltd., Aichi, Japan

[21] Appl. No.: 654,450

[22] Filed: Sep. 26, 1984

[30] Foreign Application Priority Data

Sep. 26, 1983 [JP] Japan ..... 58-149420[U]

[51] Int. Cl.[4] ..... A62C 35/02

[52] U.S. Cl. ..... 169/54; 431/88

[58] Field of Search ..... 169/49, 54, 60, 69; 431/88, 34

[56] References Cited

U.S. PATENT DOCUMENTS 4,486,170 12/1984 Tsukada ..... 431/88

FOREIGN PATENT DOCUMENTS 0164222 10/1982 Japan ..... 431/88

1425463 2/1976 United Kingdom ..... 431/88

*Primary Examiner*—Joseph F. Peters, Jr.

*Assistant Examiner*—Scott Malpede

*Attorney, Agent, or Firm*—Pollock, Vande Sande & Priddy

[57] ABSTRACT

An automatic fire-extinguishing device for an oil burner is disclosed which is capable of manually carrying out the fire-extinguishing at the occurrence of any trouble in the oil burner as well as at the occurrence of earthquakes with good reliability and significant simplicity. The automatic fire-extinguishing device includes a movable lever which is adapted to be operated by a manual operation lever mounted on a movable shielding plate at the time of fire-extinguishing to upward move a combustion cylinder with respect to a wick receiving case through a lever mechanism to form a space between the cylinder and the case and receive the shielding plate into the space, so that the fire-extinguishing may be accomplished.

9 Claims, 4 Drawing Figures

AUTOMATIC FIRE-EXTINGUISHING DEVICE FOR OIL BURNER

BACKGROUND OF THE INVENTION

1. Field of the Invention

This invention relates to an automatic fire-extinguishing device for an oil burner, and more particularly to such an automatic fire-extinguishing device for an oil burner using a movable shielding plate which is adapted to operate at the occurrence of earthquakes.

2. Description of the Prior Art

A device for automatically carrying out the fire-extinguishing of an oil burner at the occurrence of earthquakes which uses a movable shielding plate has an advantage that it carries out the fire-extinguishing also when any trouble such as failure in the vertical operation of a wick occurs. However, the fire-extinguishing of an oil burner at the occurrence of such trouble by a conventional fire-extinguishing device often lacks reliability and generally is not carried out with a simple operation.

Thus, it is highly desired to develop an automatic fire-extinguishing device using a shielding plate adapted to operate at the occurrence of earthquakes which can positively and simply operate at the occurrence of any trouble as well as the occurrence of earthquakes.

SUMMARY OF THE INVENTION

The present invention has been made in view of the foregoing disadvantage of the prior art.

Accordingly, it is an object of the present invention to provide an automatic fire-extinguishing device for an oil burner using a shielding plate which is capable of manually accomplishing the fire-extinguishing at the occurrence of any trouble in the oil burner as well as at the occurrence of earthquakes with good reliability and significant simplicity.

In accordance with the present invention, there is provided an automatic fire-extinguishing device for an oil burner comprising a retaining element adapted to be moved with the operation of a vibration sensing means; a lift lever for allowing a combustion cylinder means of the oil burner to be vertically moved with respect to a wick receiving case of the oil burner; a driving lever adapted to be detachably engaged with the retaining element to operate the lift lever to carry out the vertical movement of the combustion cylinder means, the driving lever being held at the stationary position to allow the combustion cylinder means to be disposed on the wick receiving case through the lift lever when the retaining element is moved to cause the driving lever to be engaged with the retaining element and moved from the stationary position to upward move the combustion cylinder means through the lift lever when the retaining element is moved to cause the driving lever to be disengaged from the retaining element; a movable shielding plate adapted to be released from the stationary position to cover the wick receiving case to carry out the fire-extinguishing of the oil burner when the lift lever upward moves the combustion cylinder means to define between the combustion cylinder means and the wick receiving case a space sufficient to receive the shielding plate therein; an operation lever rotatably mounted on the movable shielding plate, the operation lever being adapted to move the driving lever to the stationary position to engage the driving lever with the retaining element when the movable shielding plate is set at the stationary position; a stopper means provided to limit the rotation of the operation lever in the direction of holding the movable shielding plate at the stationary position; and a movable lever means arranged within the range of movement of the operation lever determined when the movable shielding plate is set at the stationary position, and adapted, when it is moved in the direction of fire-extinguishing of the shielding plate by the operation lever, to thereby move the retaining element to release the engagement between the retaining element and the driving lever to upward move the combustion cylinder means through the lift lever, so that the automatic fire-extinguishing may be carried out.

In accordance with the present invention, there is also provided an automatic fire-extinguishing device for an oil burner comprising a retaining element adapted to be moved with the operation of a vibration sensing weight mounted on the oil burner; a lift lever for allowing a combustion cylinder means of the oil burner to be vertically moved with respect to a wick receiving case of the oil burner; a driving lever adapted to be detachably engaged with the retaining element to operate the lift lever to carry out the vertical movement of the combustion cylinder means, the driving lever being held at the stationary position to allow the combustion cylinder means to be disposed on the wick receiving case through the lift lever when the retaining element is moved to cause the driving lever to be engaged with the retaining element and moved from the stationary position to upward move the combustion cylinder means through the lift lever when the retaining element is moved to cause the driving lever to be disengaged from the retaining element; a movable shielding plate adapted to be released from the stationary position to cover the wick receiving case to carry out the fire-extinguishing of the oil burner when the lift lever upward moves the combustion cylinder means to define between the combustion cylinder means and the wick receiving case a space sufficient to receive the shielding plate therein; a stopper provided on the lift lever and adapted to be engaged with the shielding plate to hold the shielding plate at the stationary position and disengaged from the shielding plate to allow it to be moved to the fire-extinguishing position, the stopper being also adapted to provide a time difference in operation between the driving lever and the movable shielding plate; an operation lever rotatably mounted on the movable shielding plate and adapted to move the driving lever with the retaining element when the movable shielding plate is set at the stationary position; a stopper means mounted on the shielding plate to limit the rotation of the operation lever in the direction of holding the movable shielding plate at the stationary position; and a movable lever means arranged within the range of movement of the operation lever determined when the movable shielding plate is set at the stationary position, and adapted, when it is moved in the direction of fire-extinguishing of the shielding plate by the operation lever, to move the retaining element to release the engagement between the retaining element and the driving lever to upward move the combustion cylinder means through the lift lever, so that the automatic fire-extinguishing may be carried out; the movable lever means being formed integral with the retaining element.

Furthermore, in accordance with the present invention, there is provided an automatic fire-extinguishing device for an oil burner comprising a retaining element adapted to be moved with the operation of a vibration sensing weight mounted on the oil burner; a lift lever for allowing a combustion cylinder means of the oil burner to be vertically moved with respect to a wick receiving case of the oil burner; a driving lever adapted to be detachably engaged with the retaining element to operate the lift lever to carry out the vertical movement of the combustion cylinder means, the driving lever being held at the stationary position to allow the combustion cylinder means to be disposed on the wick receiving case through the lift lever when the retaining element is moved to cause the driving lever to be engaged with the retaining element and moved from the stationary position to upward move the combustion cylinder means through the lift lever when the retaining element is moved to cause the driving lever to be disengaged from the retaining element; a movable shielding plate adapted to be released from the stationary position to cover the wick receiving case to carry out the fire-extinguishing of the oil burner when the lift lever upward moves the combustion cylinder means; a stopper provided on the lift lever and adapted to be engaged with the shielding plate to hold the shielding plate at the stationary position and disengaged from the shielding plate to allow it to be moved to the fire-extinguishing position, the stopper being also adapted to provide a time difference in operation between the driving lever and the movable shielding plate; an operation lever rotatably mounted on the movable shielding plate and adapted to move the driving lever with the retaining element when the movable shielding plate is set at the stationary position; a stopper means mounted on the shielding plate to limit the rotation of the operation lever in the direction of holding the movable shielding plate at the stationary position; a movable lever means arranged within the range of movement of the operation lever determined when the movable shielding plate is set at the stationary position, and adapted, when it is moved in the direction of fire-extinguishing of the shielding plate by the operation lever, to move the retaining element to release the engagement between the retaining element and the driving lever to upward move the combustion cylinder means through the lift lever, so that the automatic fire-extinguishing may be carried out, the movable lever means being provided independent from the retaining element; and a first interlock means for moving the movable lever and the retaining element together and a second interlock means for moving the driving lever and the movable lever together when the driving lever is moved in the direction of setting the shielding plate by the operation lever.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same or corresponding parts throughout; wherein.

DETAILED DESCRIPTION OF THE PREFERRED EMBODIMENTS

Now, an automatic fire-extinguishing device according to the present invention will be described with reference to the accompanying drawings.

Figure 1:
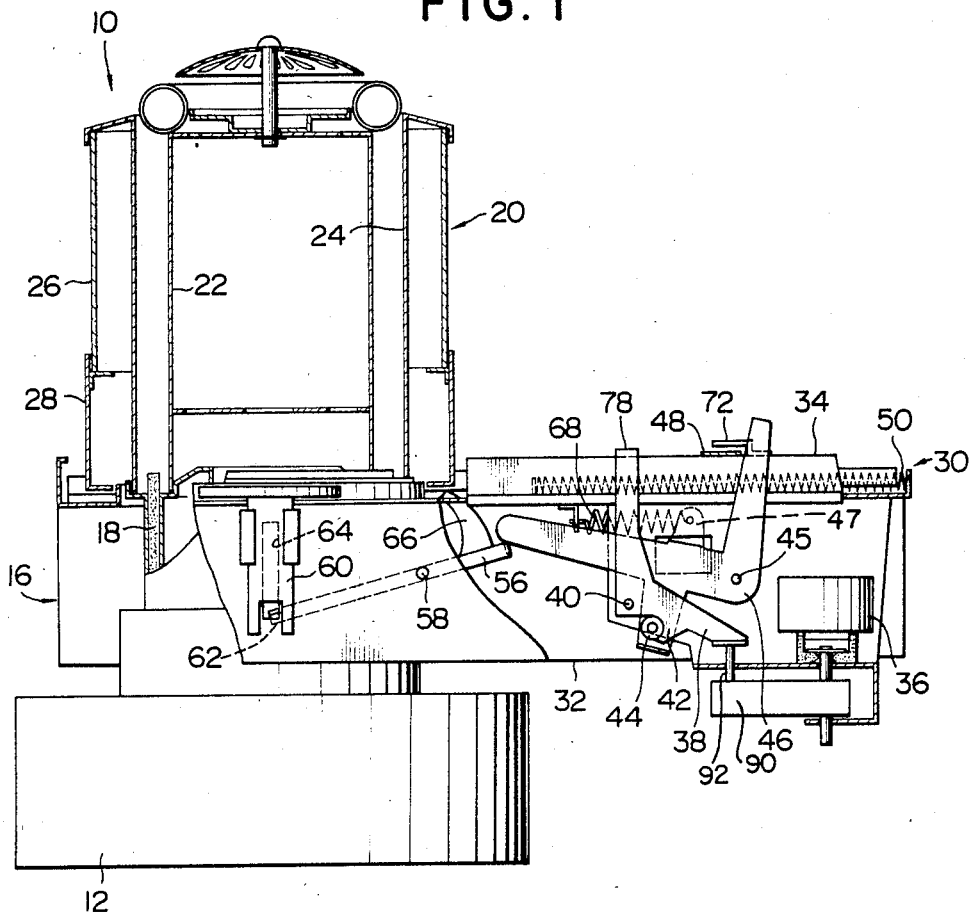
FIG. 1 is a vertical sectional view showing an oil burner having one embodiment of an automatic fire-extinguishing device according to the present invention incorporated therein wherein a movable shielding plate is set at the stationary position.

FIG. 1 illustrates an oil burner having an embodiment of an automatic fire-extinguishing device according to the present invention incorporated therein. The oil burner shown in FIG. 1 is generally designated by reference numeral 10 and in the form of a red-heated oil-fired space heater of the wick ignition type. However, it should be noted that an oil burner in which an automatic fire-extinguishing device according to the present invention is adapted to be incorporated is not limited to such a red-heated space heater.

The oil burner 10 includes an oil tank 12 for storing therein fuel oil such as kerosene and a wick receiving case 16. In the wick receiving case 16, a wick moving mechanism (not shown) is provided which is adapted to vertically move a wick 18.

Reference numeral 20 designates a combustion cylinder means which is disposed on the wick receiving case 16 so as to be upward movable with respect to the wick receiving case 16. The combustion cylinder means 20 is of the multi-cylinder type and comprises an inner cylindrical member 22, an outer cylindrical member 24 and a heat-permeable cylinder 26 disposed at the outside of the outer cylindrical member 24 which are arranged to be substantially concentrical with one another. The heat-permeable cylinder 26 is supported on a base cylinder 28. In the combustion cylinder means 20 constructed as described above, fuel oil vaporized from the wick 18 is ignited by a suitable ignition means (not shown) in a first space defined between the inner cylindrical member 22 and the outer cylindrical member 24 and burned in the first space and a second space defined between the outer cylindrical member 24 and the heat-permeable cylinder 26, resulting in the inner and outer cylindrical members 22 and 24 being red-heated. Heat rays emitted from the so red-heated cylindrical members are discharged through the heat-permeable cylinder 26 to the exterior of the combustion cylinder means 20.

An automatic fire-extinguishing device of the first embodiment shown in FIG. 1 is generally indicated by reference numeral 30 and is arranged in proximity to the wick receiving case 16. The automatic fire-extinguishing device 30 is substantially received in a casing 32 except a movable shielding plate 34 described hereinafter. The casing 32 is formed integral with the wick receiving case and into a rectangular shape in section.

The device of the illustrated embodiment includes a vibration sensing weight 36 swingably mounted at the bottom wall of the casing 32 which is adapted to operate when it senses vibration of a predetermined level or more, and a retaining element 38 provided in a relationship engaged with the vibration sensing weight 36. The retaining element 38 is mounted at the casing 32 by means of a pin 40 so as to be rotatable about the pin 40 and is adapted to be rotated when the weight 36 is operated. The retaining element 38 is provided with a retaining portion 42, which is engaged with a retaining pin 44 of a driving lever 46 to keep the retaining element 36 at a stationary state and stop the rotation of the driving lever 46, when the movable shielding plate 34 is set at the stationary position.

The driving lever member 46 is formed into a substantially L-shape and is arranged to upward project at one end thereof from the movable shielding plate 34. Also, the driving lever member 46 is adapted to be rotated about a pivot pin 45 by a manual operation lever 48 rotatably mounted on the movable shielding plate 34 and a spring 68 fixed at one end thereof to the lever member 46 and at the other end thereof to the casing 32. More particularly, when the movable shielding plate 34 is to be set at the stationary position, the lever 46 is pushed at one end thereof or the upward projecting end against the spring 68 by the operation lever 48 moved in the right direction in FIG. 1 to be rotated in the clockwise direction, so that the retaining pin 44 of the driving lever member 46 is securely engaged with the retaining portion 42 of the retaining element 38 to hold the lever 46 at the position shown in FIG. 1; whereas, when the retaining element 38 is released from the retaining pin 44 in a manner as described hereinafter, the driving lever member 46 is rotated in the counterclockwise direction by the spring 68 to have a position shown in FIG. 3.

The driving lever 46 is rotated in a counterclockwise direction in the following manner. Referring to FIG. 1, the compression spring 68 is arranged in a manner to be fixed at one end thereof to the casing 32 and at the other end thereof to an extension 47 of the driving lever member 46 to constantly urge the driving lever member 46 so that the lever 46 may be rotated in the counterclockwise direction in FIG. 1. However, the rotation of the lever 46 is normally restrained by the engagement between the retaining pin 44 of the lever 46 and the retaining portion 42 of the retaining element 38 to keep the lever at a stationary position. When the movable lever 78 or the vibration sensing weight 36 is actuated, the retaining element 38 is caused to rotate about the pivot pin 40 so as to disengage the retaining pin 44 of the lever 46 from the retaining portion 42. The compression spring 68 then causes the lever 46 to be rotated in the counterclockwise direction of FIG. 1 to place the lever 46 in the state shown in FIG. 3.

Against the other end of the driving lever member 46 is abutted the head portion of a lift lever 56 of a substantially U-shape which is mounted through a pivot pin 58 to the casing 32 so as to be rotatable about the pin 58. In the illustrated embodiment, the lift lever 56 is adapted to engaged at one end thereof with the underside of the other end of driving lever member 46. The lift lever 56 of a substantially U-shape supports, on the both ends 62 thereof, a means 60 for vertically moving the combustion cylinder means 20 with respect to the wick receiving case 16. Each of the both ends 62 of the lift lever 56 is slidably fitted in a guide groove 64 formed at each of the side walls of the casing 32 to vertically move the means 60. In the illustrated embodiment, the means 60 is constructed in a manner widely known in the art. The lift lever 56, when the driving lever member 46 is rotated in the counterclockwise direction in FIG. 1, is rotated about the pin 58 in the clockwise direction because the one end of the lift lever 56 is downward pushed by the other end of the driving lever member 46; so that the lift lever 56 may upward move the means 60 mounted on the other end thereof.

Thus, in FIG. 1, when the weight 36 is vibrated, for example, by the occurrence of earthquakes to cause the retaining element 38 to be released from the retaining pin 44, the driving lever member 46 is rotated in the counterclockwise direction by the spring 68 to rotate the lift lever 56 in the clockwise direction about the pin 58, to thereby upward move the combustion cylinder means 20. This results in a space being defined between the combustion cylinder means 20 and the wick receiving case 16, into which the movable shielding plate 34 is slidably inserted in a manner described hereinafter.

The lift lever 56 is provided on the upper surface thereof with a projection or stopper 66, which upward extends from the lift lever 56 and is adapted to be engaged with the forward end of the shielding plate 34 when it is moved to the stationary position, as described hereinafter.

The movable shielding plate 34 is formed into a substantially inverted U-shape in section to cover the top of the casing 32 and mounted on the casing 32 to be slidable with respect to the casing 32 and the wick receiving case 16. Also, the movable shielding plate 34 is constantly biased toward the wick receiving case 16 by a compression spring 50. The manual operation lever 48 is pivotally mounted on the shielding plate through a pin 70 so as to be rotatable about the pin 70. The movable shielding plate 34 is also provided thereon with a stopper means 72, which is arranged at the position of stopping the rotation of the operation lever 48 in the direction of setting the shielding plate 34 to the stationary position. Thus, it will be noted that the movable shielding plate 34 is moved to the stationary position by rotating the operation lever 48 in the counterclockwise direction about the pin 70 in FIG. 2 to abut the lever 48 against the stopper means 72 and further moving the operation lever 48 in the right direction in FIG. 2 while keeping the engagement between the lever 48 and the stopper means 72. In this instance, the operation lever 48 also abuts against the driving lever 46 to rotate the lever 46 about the pivot pin 45 in the clockwise direction against the spring 68 to engage the retaining pin 44 of the lever 46 with the retaining portion 42 of the retaining element 38, so that the lift lever 56 is rotated about the pin 58 in the counterclockwise direction by weight of the combustion cylinder means 20 to upward project the projection or stopper 66 from the casing 32. This results in the stopper 66 engaging the front end of the shielding plate 34 to set it at the stationary position, as shown in FIG. 1.

The stopper 66 extends from the lift lever 56 to have a length sufficient to be engaged with the front or forward end of the shielding plate 34 to keep the movable shielding plate 34 at the stationary position until the driving lever member 46 is released from the retaining element to upward move the means 60 and combustion cylinder means 20 through the lift lever 56, to thereby provide between the combustion cylinder means 20 and the wick receiving case 16 a space sufficient to receive the shielding plate 34 therein.

The automatic fire-extinguishing device of the illustrated embodiment further includes a movable lever 78 having an upper end normally projecting upward from the casing 32. The movable lever 78 is provided in a manner such that the upper end thereof is arranged within the range of movement of the manual operation lever 48 defined when the movable shielding plate 34 is set at the stationary position, and is lowered from the upper surface of the casing 32 when the operation lever 48 is rotated in the clockwise direction in FIG. 2 to abut against the upper end of the lever 78, to thereby release the retaining portion 42 of the retaining element 38 from the engagement with retaining pin 44 of the driving lever 46. In the illustrated embodiment, the movable lever 78 is formed integral with the retaining element 38 and upward extends therefrom.

Now, the manner of operation of the automatic fire-extinguishing device of the illustrated embodiment will be described with reference to FIGS. 1 to 3.

First, the operation of the device carried out when vibration such as earthquake occurs will be described.

When vibration of a predetermined level or more occurs in the case where the automatic fire-extinguishing device is in the state shown in FIG. 1, the vibration sensing weight 36 is operated or swung to disengage the retaining portion 42 of the retaining element 38 from the retaining pin 44 of the driving lever 46 to rotate the lift lever 56 in the clockwise direction in FIG. 1. This permits the combustion cylinder means 20 to be upward moved with respect to the wick receiving case 16 to define a space therebetween. Then, the stopper 66 of the lift lever 56 is fully lowered from the upper surface of the casing 32 when a space is defined between the case 16 and the combustion cylinder means 20 which is sufficient to receive the shielding plate 34 therein, thus, the shielding plate 34 urged by the spring 50 is allowed to enter the space to isolate the wick receiving case 16 from the combustion cylinder means 20, to thereby carry out the fire-extinguishing. The isolation itself using such a movable shielding plate is widely known in the art.

The vibration sensing weight 36 is actuated to release the retaining element 38 from the retaining pin 44 in the following manner. Referring to FIG. 1, when the vibration sensing weight 36 is actuated, a vertically movable member 90 attached to the lower portion of the weight is upwardly moved to push up the retaining element 38 through a support rod 92, to thereby release the retaining portion 42 of the retaining element 38 from the retaining pin 44 of the driving lever 46. This causes the driving lever 46 to be rotated about the pin 45 in the counterclockwise direction in FIG. 1 because it is constantly urged in this direction by means of the compression spring 48 so that it may be placed in the state shown in FIG. 3. Such a vibration sensing weight 36 as used in the present invention is well known in the art as taught in Japanese Patent Publication No. 44268/1979.

The manual fire-extinguishing operation in case of occurrence of any trouble in the operation will be carried out in the following manner.

Figure 2:
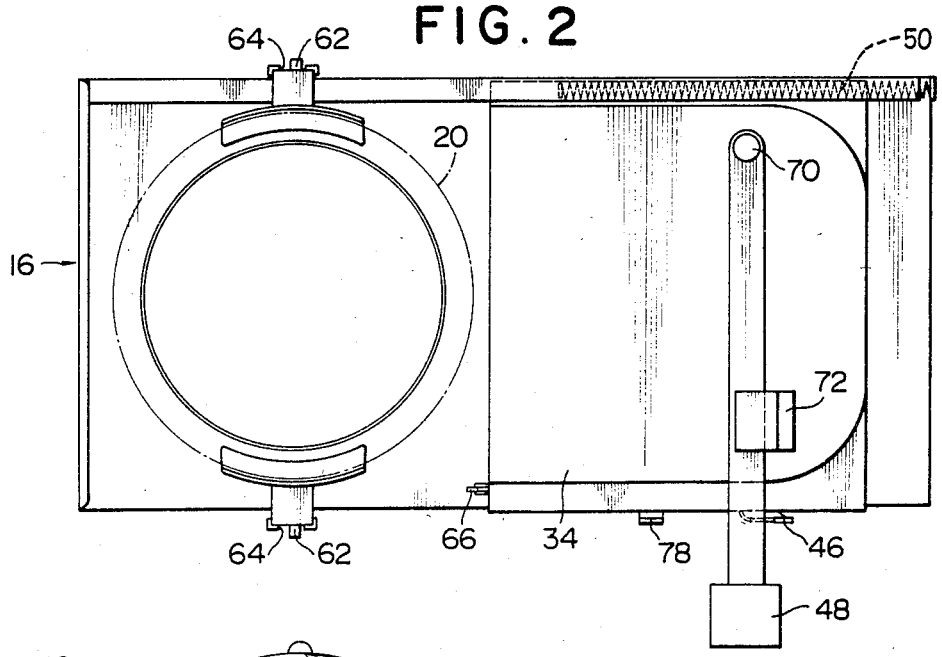
FIG. 2 is a plan view of the oil burner shown in FIG. 1 wherein a combustion cylinder means is omitted for clarity in the description.

First, when the manual operation lever 48 of the automatic fire-extinguishing device in the state shown in FIG. 1 is manually rotated in the clockwise direction in FIG. 2 to downward push the projecting end of the movable lever 78; the retaining portion 42 of the retaining element 38 is released from the retaining pin 44 of the driving lever 46 to allow the driving lever 46 to be rotated in the counterclockwise direction in FIG. 1 by the spring 68, so that the lift lever 56 is rotated in the clockwise direction to upward move the combustion cylinder means 20. This results in the isolation between the combustion cylinder means 20 and the wick receiving case 16 being carried out, and then the shielding plate 34 is moved into a space therebetween in the same manner as described above.

The shifting of the shielding plate 34 from the fire-extinguishing position shown in FIG. 3 to the stationary position shown in FIG. 1 and the setting of the plate at the stationary position will be carried out in the following manner.

Figure 3:
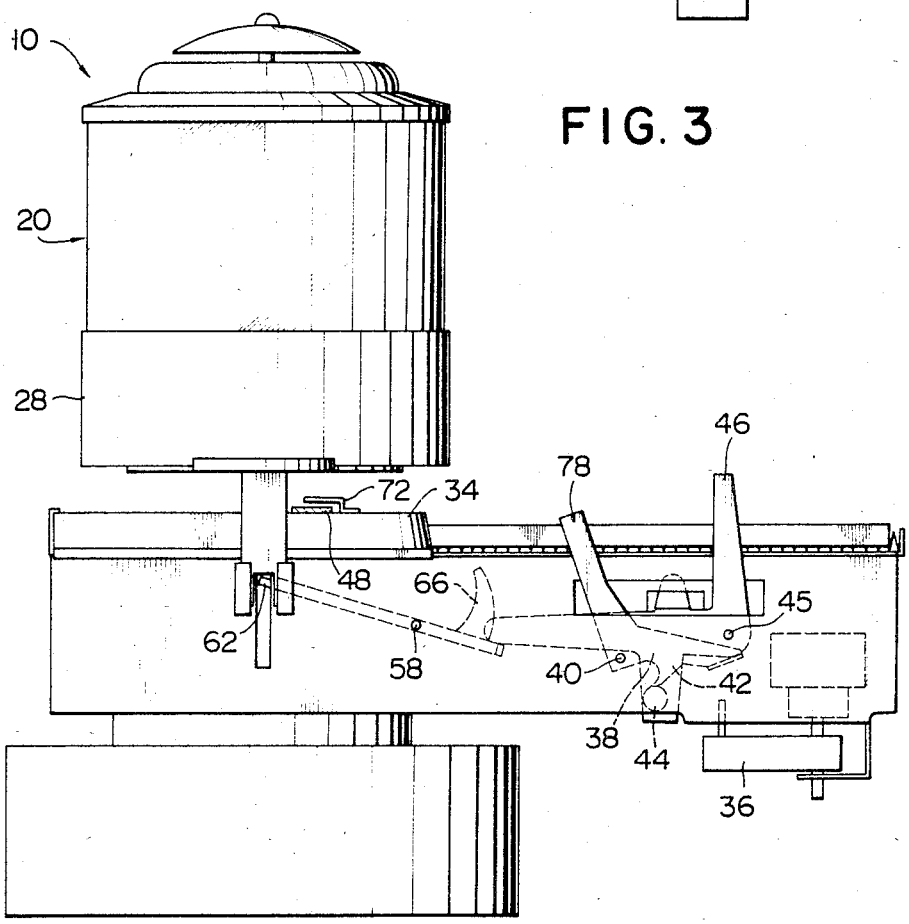
FIG. 3 is front view in partly section of the oil burner shown in FIG. 1 wherein the movable shielding plate is moved to the fire-extinguishing position.

When the manual operation lever 48 of the device 30 in the state shown in FIG. 3 is rotated in the direction of setting the movable shielding plate 34 to the stationary position, the operation lever 48 passes through the movable lever 78 because it is lowered from the top surface of the shielding plate, and then abuts against the driving lever 46 to rotate it in the clockwise direction in FIG. 3 with the movement of the movable shielding plate 34. This results in the retaining pin 44 of the driving lever 46 being securely engaged with the retaining portion 42 of the retaining element 38 against the spring 68 to be held at the stationary position and the shielding plate 34 being moved to the stationary position against the spring 50. Concurrently, the lift lever 56 is rotated in the counterclockwise direction in FIG. 3 by weight of the combustion cylinder means and the like because it is released at the one end thereof from the downward forcing by the driving lever 46, so that the the stopper 66 of the lift lever 56 may be projected from the top of the casing 32 to stop the movement of the shielding plate in the direction of the wick receiving case 16, to thereby hold it at the stationary position.

Figure 4:
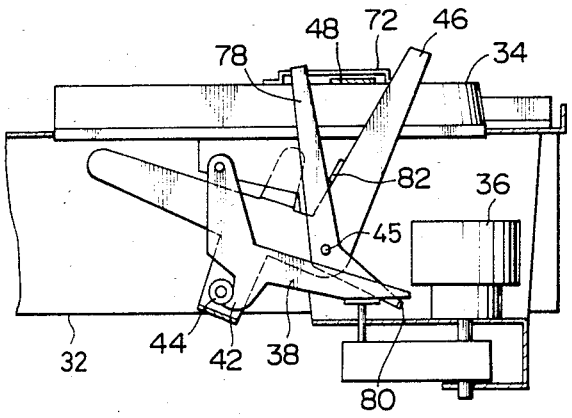
FIG. 4 is a schematic vertical sectional view showing the essential part of another embodiment of an automatic fire-extinguishing device according to the present invention.

FIG. 4 is a schematic view showing the essential part of another embodiment of an automatic fire-extinguishing device according to the present invention. The embodiment shown in FIG. 4 is constructed in the substantially same manner as the first embodiment described above, except a movable lever 78. More particularly, in the second embodiment illustrated, the movable lever 78 is provided independent from a retaining element 38. The movable lever 78 is formed into a substantially L-shape and is loosely fitted on a pivot pin 45 of a driving lever 46 so as to be rotatable about the pin 45. The movable lever 78 is provided at the lower portion thereof with a means for moving the movable lever with the retaining element 38 or a first interlock means 80. Also, the driving lever 46 is provided with a second interlock means 82 for moving the movable lever 78 with the driving lever 46 particularly when the driving lever 46 is rotated in the clockwise direction by the operation lever 48. It is of course that the movable lever 78 is provided so as to project at one end thereof from the top of a casing 32 when a movable shielding plate 34 is held at the stationary position as shown in FIG. 4, and the retaining element is received in the casing 32.

In the second embodiment constructed as described above, the manual fire-extinguishing operation is carried out in the following manner.

First, when the manual operation lever 48 is rotated in the direction of a wick receiving case (not shown) to abut against the movable lever 78, it is rotated in the counterclockwise direction about the pivot pin 45 in FIG. 4 to cause the retaining element 38 to be rotated in the counterclockwise direction through the means for forming the engagement between the retaining element 38 and the movable element 78 or the first interlock means 80, to thereby release the retaining element 38 from the engagement with the driving lever 46.

The movement of the shielding plate 34 from the fire-extinguishing position to the stationary position and the holding it at the position are carried out in the following manner.

The manual operation lever 48 is moved in the direction away from the wick receiving case to pass through the movable lever 78 and abut against the driving lever 46 and then to move the shielding plate to the stationary position. At this time, the second interlock member 82 rotates the movable lever 78 in the clockwise direction with the clockwise rotation of the driving lever 46 to rotate the retaining element 38 in the clockwise direction through the first interlock means 80, so that the retaining element 38 is engaged at the retaining portion 42 thereof with the retaining pin 44 of the driving lever 46. This results in a stopper 66 of a lift lever 56 (not shown) upward projecting from the top of the casing 32 to hold the shielding plate 34 at the stationary position.

As described above, in the automatic fire-extinguishing device of the present invention, the movable lever is provided to be moved with the retaining element and the manual operation lever is mounted on the shielding plate so as to be rotatable about the pivot pin in the fire-extinguishing direction; thus, the movable lever can be moved while holding the movable shielding plate at the stationary position, to thereby carry out the forcible disengagement between the retaining element and the retaining pin of the driving lever. Accordingly, the driving lever can upward move the combustion cylinder means utilizing the force of the spring 68 through the lift lever and lower the stopper 66 below the top of the casing, so that the shielding plate is moved into a space between the combustion cylinder means and the wick receiving case to carry out the fire-extinguishing.

Accordingly, the present invention can effectively and positively carry out the manual fire-extinguishing in case of an emergency and/or occurrence of any trouble in the operation with ease as well as the fire-extinguishing at the time of occurrence of earthquakes, because it is merely required to move the manual operation lever in the direction opposite to that of setting the shielding plate to the stationary position.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to be fall therebetween.

What is claimed is:

1. An automatic fire-extinguishing device for an oil burner comprising:

a retaining element adapted to be moved with the operation of a vibration sensing means;

a lift lever for allowing a combustion cylinder means of said oil burner to be vertically moved with respect to a wick receiving case of said oil burner;

a driving lever adapted to be detachably engaged with said retaining element to operate said lift lever to carry out the vertical movement of said combustion cylinder means, said driving lever being held at the stationary position to allow said combustion cylinder means to be disposed on said wick receiving case through said lift lever when said retaining element is moved to cause said driving lever to be engaged with said retaining element and moved from the stationary position to upward move said combustion cylinder means through said lift lever when said retaining element is moved to cause said driving lever to be disengaged from said retaining element;

a movable shielding plate adapted to be released from the stationary position to cover said wick receiving case to carry out the fire-extinguishing of said oil burner when said lift lever upward moves said combustion cylinder means to define between said combustion cylinder means and said wick receiving case a space sufficient to receive said shielding plate therein;

an operation lever rotatably mounted on said movable shielding plate, said operation lever being adapted to move said driving lever to the stationary position to engage said driving lever with said retaining element when said movable shielding plate is set at the stationary position;

a stopper means provided to limit the rotation of said operation lever in the direction of holding said movable shielding plate at the stationary position; and a movable lever means arranged within the range of movement of said operation lever determined when said movable shielding plate is set at the stationary position, and adapted, when it is moved in the direction of fire-extinguishing of said shielding plate by said operation lever, to thereby move said retaining element to release the engagement between said retaining element and said driving lever to upward move said combustion cylinder means through said lift lever, so that the automatic fire-extinguishing may be carried out.

2. An automatic fire-extinguishing device as defined in claim 1, wherein said lift lever is provided with a stopper for said movable shielding plate, said stopper being adapted to hold said movable shielding plate at the stationary position by engaging with said shield plate and allow said shielding plate to be moved to the fire-extinguishing position by disengaging from said shielding plate.

3. An automatic fire-extinguishing device for an oil burner as defined in claim 2, wherein said stopper of said lift lever is adapted to provide a time difference in operation between said driving lever and said movable shielding plate.

4. An automatic fire-extinguishing device for an oil burner as defined in claim 1, wherein said driving lever is engaged with said retaining element against the force of a spring means and is moved by the force of said spring means when it is disengaged from said retaining element.

5. An automatic fire-extinguishing device for an oil burner as defined in claim 1, wherein said movable lever is formed integral with said retaining element.

6. An automatic fire-extinguishing device for an oil burner as defined in claim 1, wherein said movable lever is provided independent from said retaining element.

7. An automatic fire-extinguishing device for an oil burner as defined in claim 6 further comprising a first interlock means for moving said movable lever and said retaining element together, and a second interlock means for moving said driving lever and said movable lever together when said driving lever is moved in the direction of setting of said shielding plate by said operation lever.

8. An automatic fire-extinguishing device for an oil burner comprising:

a retaining element adapted to be moved with the operation of a vibration sensing weight mounted on said oil burner;

a lift lever for allowing a combustion cylinder means of said oil burner to be vertically moved with respect to a wick receiving case of said oil burner;

a driving lever adapted to be detachably engaged with said retaining element to operate said lift lever to carry out the vertical movement of said combustion cylinder means, said driving lever being held at the stationary position to allow said combustion cylinder means to be disposed on said wick receiving case through said lift lever when said retaining element is moved to cause said driving lever to be engaged with said retaining element and moved from the stationary position to upward move said combustion cylinder means through said lift lever when said retaining element is moved to cause said driving lever to be disengaged from said retaining element;

a movable shielding plate adapted to be released from the stationary position to cover said wick receiving case to carry out the fire-extinguishing of said oil burner when said lift lever upward moves said combustion cylinder means to define between said combustion cylinder means and said wick receiving case a space sufficient to receive said shielding plate therein;

a stopper provided on said lift lever and adapted to be engaged with said shielding plate to hold said shielding plate at the stationary position and disengaged from said shielding plate to allow it to be moved to the fire-extinguishing position, said stopper being also adapted to provide a time difference in operation between said driving lever and said movable shielding plate;

an operation lever rotatably mounted on said movable shielding plate and adapted to move said driving lever with said retaining element when said movable shielding plate is set at the stationary position;

a stopper means mounted on said shielding plate to limit the rotation of said operation lever in the direction of holding said movable shielding plate at the stationary position; and a movable lever means arranged within the range of movement of said operation lever determined when said movable shielding plate is set at the stationary position, and adapted, when it is moved in the direction of fire-extinguishing of said shielding plate by said operation lever, to move said retaining element to release the engagement between said retaining element and said driving lever to upward move said combustion cylinder means through said lift lever, so that the automatic fire-extinguishing may be carried out;

said movable lever means being formed integral with said retaining element.

9. An automatic fire-extinguishing device for an oil burner comprising:

a retaining element adapted to be moved with the operation of a vibration sensing weight mounted on said oil burner;

a lift lever for allowing a combustion cylinder means of said oil burner to be vertically moved with respect to a wick receiving case of said oil burner;

a driving lever adapted to be detachably engaged with said retaining element to operate said lift lever to carry out the vertical movement of said combustion cylinder means, said driving lever being held at the stationary position to allow said combustion cylinder means to be disposed on said wick receiving case through said lift lever when said retaining element is moved to cause said driving lever to be engaged with said retaining element and moved from the stationary position to upward move said combustion cylinder means through said lift lever when said retaining element is moved to cause said driving lever to be disengaged from said retaining element;

a movable shielding plate adapted to be released from the stationary position to cover said wick receiving case to carry out the fire-extinguishing of said oil burner when said lift lever upward moves said combustion cylinder means;

a stopper provided on said lift lever and adapted to be engaged with said shielding plate to hold said shielding plate at the stationary position and disengaged from said shielding plate to allow it to be moved to the fire-extinguishing position, said stopper being also adapted to provide a time difference in operation between said driving lever and said movable shielding plate;

an operation lever rotatably mounted on said movable shielding plate and adapted to move said driving lever with said retaining element when said movable shielding plate is set at the stationary position;

a stopper means mounted on said shielding plate to limit the rotation of said operation lever in the direction of holding said movable shielding plate at the stationary position;

a movable lever means arranged within the range of movement of said operation lever determined when said movable shielding plate is set at the stationary position, and adapted, when it is moved in the direction of fire-extinguishing of said shielding plate by said operation lever, to move said retaining element to release the engagement between said retaining element and said driving lever to upward move said combustion cylinder means through said lift lever, so that the automatic fire-extinguishing may be carried out, said movable lever means being provided independent from said retaining element; and a first interlock means for moving said movable lever and said retaining element together, and a second interlock means for moving said driving lever and said movable lever together when said driving lever is moved in the direction of setting of said shielding plate by said operation lever.

* * * * *